US011668122B2

(12) United States Patent
Vedholm

(10) Patent No.: US 11,668,122 B2
(45) Date of Patent: Jun. 6, 2023

(54) ARRANGEMENT FOR A VEHICLE, IN PARTICULAR A RAIL VEHICLE, OR FOR A BUILDING AND A METHOD OF OPERATING THE VEHICLE OR THE BUILDING

(71) Applicant: Bombardier Transportation GmbH, Berlin (DE)

(72) Inventor: Jonas Vedholm, Vasteras (SE)

(73) Assignee: Bombardier Transportation GmbH, Berlin (DE)

( * ) Notice: Subject to any disclaimer, the term of this patent is extended or adjusted under 35 U.S.C. 154(b) by 621 days.

(21) Appl. No.: 16/471,210

(22) PCT Filed: Dec. 19, 2017

(86) PCT No.: PCT/EP2017/083667
§ 371 (c)(1),
(2) Date: Jun. 19, 2019

(87) PCT Pub. No.: WO2018/115030
PCT Pub. Date: Jun. 28, 2018

(65) Prior Publication Data

US 2020/0087949 A1 Mar. 19, 2020

(30) Foreign Application Priority Data

Dec. 22, 2016 (EP) ..... 16206383

(51) Int. Cl.
*E05B 83/36* (2014.01)
*E05B 47/00* (2006.01)
(Continued)

(52) U.S. Cl.
CPC ..... *E05B 83/363* (2013.01); *B61D 37/00* (2013.01); *B61D 49/00* (2013.01);
(Continued)

(58) Field of Classification Search
CPC ..... E05B 47/0001; E05B 65/00; E05B 2047/0086; E05B 83/04; E05B 83/06;
(Continued)

(56) References Cited

U.S. PATENT DOCUMENTS 4,468,942 A * 9/1984 Grabner ..... E05B 77/50 70/264
4,494,805 A * 1/1985 Washburn ..... E05B 47/0002 312/215
(Continued)

FOREIGN PATENT DOCUMENTS

AU 2015217685 B2 3/2018
CN 2564187 Y 8/2003
(Continued)

OTHER PUBLICATIONS

Assaabloy, Lockwood 3580 Series Electric Mortice Lock—www.assaabloy.co.nz/ (Downloaded from internet on Jan. 25, 2016).

*Primary Examiner* — Christopher J Boswell
(74) *Attorney, Agent, or Firm* — The Webb Law Firm

(57) ABSTRACT

An arrangement for a vehicle, in particular a rail vehicle, or for a building, has a control system adapted to control a plurality of different devices, a cabinet having a lock that can be locked in order to prevent access to a valuable device within the cabinet, and a control unit of the control system adapted to remotely control unlocking the lock. The control system is adapted to unlock the lock automatically if a predetermined condition is fulfilled or to unlock the lock on demand.

12 Claims, 2 Drawing Sheets

(51) Int. Cl.

| | |
|---|---|
| ***E05B 77/54*** | (2014.01) |
| ***B61D 49/00*** | (2006.01) |
| ***E05B 65/00*** | (2006.01) |
| ***B61D 37/00*** | (2006.01) |

(52) U.S. Cl.
CPC ..... *E05B 47/0001* (2013.01); *E05B 65/00* (2013.01); *E05B 77/54* (2013.01); *E05B 2047/0086* (2013.01)

(58) Field of Classification Search
CPC ..... E05B 83/363; E05B 77/54; B61D 49/00; B61D 37/00; B61C 17/00; E05G 1/06; E05G 1/08; Y10T 70/5128; Y10T 70/5133; Y10T 70/65; Y10T 70/7102; Y10T 70/7107; Y10T 70/7113; Y10T 70/7119; Y10T 70/7124
USPC ..... 70/85, 86, 264, 278.7, 279.1, 280–282; 109/56, 57
See application file for complete search history.

(56) References Cited

U.S. PATENT DOCUMENTS

| | | | | | |
|---|---|---|---|---|---|
| 5,172,970 | A * | 12/1992 | Momose | E05B 47/0002 | 292/201 |
| 5,359,322 | A * | 10/1994 | Murray | G07C 9/00896 | 340/5.5 |
| 5,504,325 | A * | 4/1996 | Talmon | G07C 9/00912 | 250/222.1 |
| 5,820,234 | A * | 10/1998 | Capwell | G07C 9/0069 | 312/216 |
| 5,941,106 | A * | 8/1999 | Williamson, Jr. | E05B 15/024 | 70/278.1 |
| 6,092,846 | A | 7/2000 | Fuss et al. | | |
| 6,542,071 | B1 | 4/2003 | Ohtsubo et al. | | |
| 8,267,016 | B2 * | 9/2012 | Akoshita | E05B 13/001 | 105/349 |
| 8,359,986 | B2 * | 1/2013 | Sekiguchi | E05G 1/06 | 109/53 |
| 8,723,683 | B2 | 5/2014 | Crossman et al. | | |
| 9,552,682 | B2 * | 1/2017 | Luke | B60L 3/0046 | |
| 10,316,555 | B2 * | 6/2019 | Stephens | E05B 65/0021 | |
| 2006/0152339 | A1 * | 7/2006 | Mercier | G07F 17/12 | 340/5.73 |
| 2009/0231132 | A1 * | 9/2009 | Shoenfeld | E05B 63/24 | 340/542 |
| 2015/0115622 | A1 * | 4/2015 | Burdenko | E05B 47/0001 | 292/138 |
| 2016/0053514 | A1 * | 2/2016 | Savage | E05G 1/08 | 312/326 |
| 2018/0340350 | A1 * | 11/2018 | Johnson | G07C 9/00571 | |

FOREIGN PATENT DOCUMENTS

| | | | | | |
|---|---|---|---|---|---|
| CN | 2609593 | Y | 4/2004 | | |
| CN | 101302907 | A | 11/2008 | | |
| CN | 201668916 | U | 12/2010 | | |
| CN | 202467479 | U | 10/2012 | | |
| CN | 202859973 | U | 4/2013 | | |
| CN | 203001742 | U | 6/2013 | | |
| CN | 203227237 | U | 10/2013 | | |
| EP | 0086617 | B1 | 8/1983 | | |
| EP | 2705994 | A1 | 3/2014 | | |
| JP | 2006299532 | A | 11/2006 | | |
| KR | 200431443 | Y1 * | 11/2006 | | E05B 81/06 |
| KR | 101255088 | A | 4/2013 | | |
| WO | 2011015895 | A1 | 2/2011 | | |
| WO | 2012134402 | A1 | 10/2012 | | |
| WO | 2014179403 | A1 | 11/2014 | | |
| WO | WO-2016008933 | A1 * | 1/2016 | | B61D 19/023 |
| WO | WO-2022122168 | A1 * | 6/2022 | | B61D 19/023 |

* cited by examiner

ARRANGEMENT FOR A VEHICLE, IN PARTICULAR A RAIL VEHICLE, OR FOR A BUILDING AND A METHOD OF OPERATING THE VEHICLE OR THE BUILDING

CROSS-REFERENCE TO RELATED APPLICATIONS

This application is the United States national phase of International Application No. PCT/EP2017/083667 filed Dec. 19, 2017, and claims priority to European Patent Application No. 16206383.8 filed Dec. 22, 2016, the disclosures of which are hereby incorporated by reference in their entirety.

BACKGROUND OF THE INVENTION

Field of the Invention

The invention relates to an arrangement for a vehicle, in particular a rail vehicle, or for a building. More specifically, the rail vehicle may be a rail vehicle for transporting passengers and/or freight, a railway car, a rail vehicle driven by a locomotive, a multiple unit, a monorail vehicle, an automated people mover and/or a rail vehicle or train set of any type. However, the types of rail vehicles are not limited to currently known types. Other types of vehicles include, for example and not limited to these types, ships, airplanes, coaches and busses. A building can be e.g. a train station, a coach terminal, a bus terminal, an airport, a location for cultural events, a shopping mall and/or any other type of open or closed public or private building. The invention also relates to a method of operating such a vehicle or building. In particular, the invention relates to valuable devices to be arranged in vehicles or buildings. Examples of such valuable devices are fire extinguishers, fire blankets, emergency escape hammers, defibrillators and first aid kits. More generally speaking, the invention relates to valuable devices which are valuable with regard to safety and/or health.

Description of Related Art

In case of fire onboard a rail vehicle, passengers should be able to extinguish the fire or at least to slow down the spreading of the fire. The same applies to people in other vehicles or buildings. Therefore, fire extinguishers for manual operation can be placed within vehicles or buildings. Unfortunately, fire extinguishers in areas which are accessible to the public are subject to vandalism or theft. Therefore, the fire extinguishers may be removed temporarily or even completely, if the exposure to vandalism and theft is high. This increases the likelihood that a fire cannot be extinguished in case of an emergency. Similar circumstances apply to other valuable devices, especially first aid kits and defibrillators in case of health problems.

SUMMARY OF THE INVENTION

It is an object of the present invention to propose an arrangement for a vehicle, in particular a rail vehicle, or for a building and a method of operating a vehicle, in particular a rail vehicle, or of operating a building which provide for availability of at least one valuable device onboard the vehicle or within the building at low risk of vandalism and theft.

According to a basic idea of the present invention, at least one valuable device and preferably a plurality of valuable devices (e.g. at least one fire extinguisher and/or at least one defibrillator) is/are locked within a cabinet or in a plurality of cabinets and the lock or locks of the cabinet are controlled to unlock, if required, by a control system of the vehicle, in particular the rail vehicle, or of the building.

EP 2 705 994 A1 describes a control arrangement for a train set, comprising a first control device associated to a first driver's stand of a first vehicle of the train set, a second control device associated to a second driver's stand of a second vehicle of the train set, and a data bus system connecting the first control device and the second control device to at least one controlled component of the train set.

The control arrangement of EP 2 705 994 A1 is an example of a control system onboard a rail vehicle which can be used to control unlocking fire extinguisher cabinets. However, the invention is not limited to the use of the control arrangement of EP 2 705 994 A1. Rather, any control system of a rail vehicle, in particular a train control system in case of a railway train, can be amended to also control unlocking the fire extinguisher cabinet(s). Using the terminology of EP 2 705 994 A1, the lock of the respective cabinet or a unit which is associated with the lock becomes a component controlled by the control arrangement.

The control system of the vehicle or of the building enables remotely unlocking the lock. Therefore, the at least one valuable device within the cabinet is protected against vandalism and theft while the valuable device is not required. In addition, the at least one valuable device within the cabinet can be made available using the control system to remotely control unlocking the lock. For example, this makes available a fire extinguisher for firefighting and/or a defibrillator for reactivating regular heartbeat.

In particular, an arrangement is proposed for a vehicle, in particular a rail vehicle, or for a building, the arrangement comprising:

- a control system, in particular onboard the vehicle or within the building, the control system being adapted to control a plurality of devices of different kind onboard the vehicle or within the building,
- a cabinet for at least one valuable device having a lock that can be locked in order to prevent access to at least one valuable device within the cabinet, and
- a control unit of the control system adapted to remotely control unlocking the lock,
- wherein the control system is adapted to unlock the lock automatically if a predetermined condition is fulfilled and/or to unlock the lock on demand.

Furthermore, a vehicle, in particular a rail vehicle, or a building with the arrangement is proposed, i.e. the arrangement is arranged onboard the vehicle or as part of the building.

In addition, a method is proposed of operating a vehicle, in particular a rail vehicle, or a building by using a control system onboard the vehicle or within the building to control a plurality of devices of different kind onboard the vehicle or within the building,

- wherein the control system is used to remotely unlock
  - automatically if a predetermined condition is fulfilled, and/or
  - on demand, and
  - a lock of a cabinet in order to give access to at least one valuable device within the cabinet that is otherwise locked.

In particular, the cabinet comprises at least one door, a flap and/or another closing device that closes an opening of the cabinet through which a valuable device can be withdrawn from the cabinet. The closing device is combined with the lock and is blocked from releasing the opening and the valuable device while the lock is in the locked state. Unlocking the lock enables the closing device to be opened or triggers the closing device to automatically open so that the valuable device can be removed from the cabinet. It is also possible that the valuable device is automatically dispensed from the cabinet and/or is automatically moved at least partially out of the cabinet if the lock is unlocked.

In the following, embodiments, examples and advantages of the invention will be described. Embodiments of the arrangement and of the method follow from each other. This means that the vehicle or building can be operated as follows from the description of the arrangement and the arrangement can be constituted as follows from the description of the method.

In particular, the control system comprises a plurality of communication connections between different devices and/or systems of the vehicle or of the building. It is preferred that the control system is communicatively connected to an interacting device (e.g. a manual switch, a keyboard and/or a touch-screen) of a driver's cab of the vehicle or of a control room of the building. In this manner, the driver or controller can interact using the interacting device with the control system.

In this embodiment and in other embodiments, the controller may be a person, a robot or a computer.

In addition or alternatively, the driver or controller or any other member of staff can interact with the control system so as to demand unlocking the lock of the cabinet. By such an interaction, the control system is triggered to control unlocking the lock. Optionally, also an interface of the control system can be used which can be observed by the driver or controller or other member of staff, such as an HMI (human man interface), a screen or an acoustic and/or visual signaling device. Via the interface, the control system may signal the request to the driver or controller or member of staff to unlock the lock.

In addition or alternatively, an interacting device which can be used by the driver or controller or any other member of staff can be connected to an unlocking device in a different manner, in particular via a signal line directly connecting the interacting device with the unlocking device. If the driver or controller or other member of staff interacts with the interacting device, the unlocking device is triggered to unlock the lock of the cabinet.

The term "staff" is not limited to staff members travelling with the rail vehicle or located within the building, although these staff members are also included. Staff members can also be persons on the wayside next to a railway (e.g. within a train station) or other vehicle path and/or within a control center for controlling traffic in a railway system or outside of the building. A corresponding embodiment of the control system onboard the vehicle will be described later.

In particular, as mentioned before, certain events may happen and the lock should be unlocked by the control system in these cases. One event is the detection of a fire onboard the vehicle or within the building. Therefore, the vehicle or building may comprise at least one fire detector that is connected to the control system. When a fire is detected by the fire detector, the fire detector transmits a signal to the control system.

According to one embodiment, the lock can be controlled to unlock by the control system automatically in reaction to the receipt of the signal. In addition or alternatively, the information that access to the valuable device within the cabinet is required (for example a fire has been detected or a person has a heart attack) can be transferred by the control system to the driver or controller or to at least one other member of the staff. Therefore, the driver or controller or other member of staff can demand unlocking the lock. In the latter case, it is not necessary, although preferred, that a fire detector is connected to the control system. It is also possible that the fire detector is connected to any indication device or interface (for example a display, an alarm sound generator and/or a lamp) in the driver's cab or at a place where staff members monitor the operation and/or state of the vehicle or building. Other examples of generating and transmitting the request to unlock the lock to the driver or other member of staff are an emergency intercom or information system for a passenger or for a user of the building. Thereby, a passenger or user of the building having detected the need to fight a fire or to use a defibrillator may generate the request, which is then transmitted by the intercom or system to the driver or controller or other member of staff.

In particular, the lock may be an electric lock. According to a specific embodiment, the lock may be operated using an electric energy supply network of the rail vehicle or building, wherein the lock may be adapted to unlock if the electric energy supply network stops applying an electric voltage to the lock. Therefore, the electric lock is fail-safe. Generally, not only in case of this specific embodiment, an electric lock can be controlled easily by the control system. In particular, the electric energy or electric voltage can be used by the lock to either cause the transition from the unlocked to the locked state of the lock and/or vice versa and/or can be used to maintain the unlocked and/or locked state of the lock. Electric energy or electric voltage can be controlled using at least one electric switch, such as a relay. In case of the specific embodiment mentioned before, a control input of the relay can be controlled by the control system to cut down the voltage applied to the lock and the lock unlocks as a result. In this embodiment, the lock uses the electric voltage to maintain the locked state and automatically unlocks if the voltage is no longer applied to the lock.

The events of fire and/or health problems (in particular heart attack) are not the only events which may cause unlocking the lock. For example, staff and maintenance personnel should regularly check the function of the at least one valuable device within the cabinet and perform service actions in order to maintain the capability of the valuable device of being used. Therefore, the control system may be used to unlock the lock not only when the valuable device shall be applied.

Furthermore, the lock preferably comprises an unlocking device that can be actuated by a user by directly acting on the unlocked device, wherein the unlocking device can only be actuated to unlock the lock using secret knowledge and/or using a key. In particular, the lock may comprise a mechanism that is known in the art of locks for mechanically unlock the lock using a key. This means, that the lock can be unlocked by a user acting directly on the lock, in contrast to remotely unlocking using the control system, and the unlocking device overrides the locked state. This embodiment facilitates the required maintenance and servicing.

Preferably, the lock is not only connected to the control system for being controlled to unlock, but is also connected to the control system for reporting that the lock has been unlocked and/or that the cabinet has been opened. In particular, this allows for transmitting a corresponding signal from the lock to the control system that the cabinet has been opened for example by brute force. In this case, the control system can create an alarm, for example displayed or indicated to be noticed by the driver or controller or any other member of the staff. In addition, or alternatively, the alarm may cause an audible signal within the vehicle or building. Furthermore, in addition or alternatively, the control system may trigger the display of video data from a camera monitoring the area where the cabinet is placed within the train, vehicle or building. The display may take place in the driver's cab or control room and/or at any place where staff may watch the operation or state of the vehicle or building.

As mentioned before, not only persons (i.e. users) onboard the vehicle or within the building, but also other persons outside of the vehicle or building may interact with the control system onboard the vehicle or within the building. In this case, the control system has an interface for communication with the wayside or any other location outside of the vehicle or building. Therefore, for example staff within an operation control center for controlling operation of the vehicle or building and in particular further vehicles within a railway network or further buildings may interact with the control system so that the control system unlocks the lock. In particular, the communication interface may be directional so that the person or persons outside of the vehicle or building may also receive information that may be communicated within the vehicle or building, for example the information mentioned above to the driver or controller.

The vehicle, in particular the rail vehicle, is not restricted to a vehicle having a driver onboard the vehicle. Rather, the control system enables remotely unlocking the lock also in case of a driverless vehicle. Similarly, a user of the building may be within or outside of the building.

Furthermore, interaction of a person outside of the vehicle for example enables personnel at a vehicle stop or station to trigger unlocking the lock. This can be done when the valuable device is required for use or for maintenance and/or service.

The control system may comprise at least one computer using at least one computer program to perform the functions of the control system. With regard to safety of operation and external interaction, different safety integrity levels (SIL) may be implemented in the software that includes the at least program.

Embodiments and examples of the present invention will be described with reference to the attached figures in the following. While the following description refers to the example of a fire extinguisher, the invention and in particular the embodiments and examples may also apply to cabinets for accommodating other valuable devices, such as defibrillators. In addition, the following description refers to a railway train, but it may apply correspondingly to another type of vehicles or to a building.

DESCRIPTION OF THE INVENTION

Figure 1:
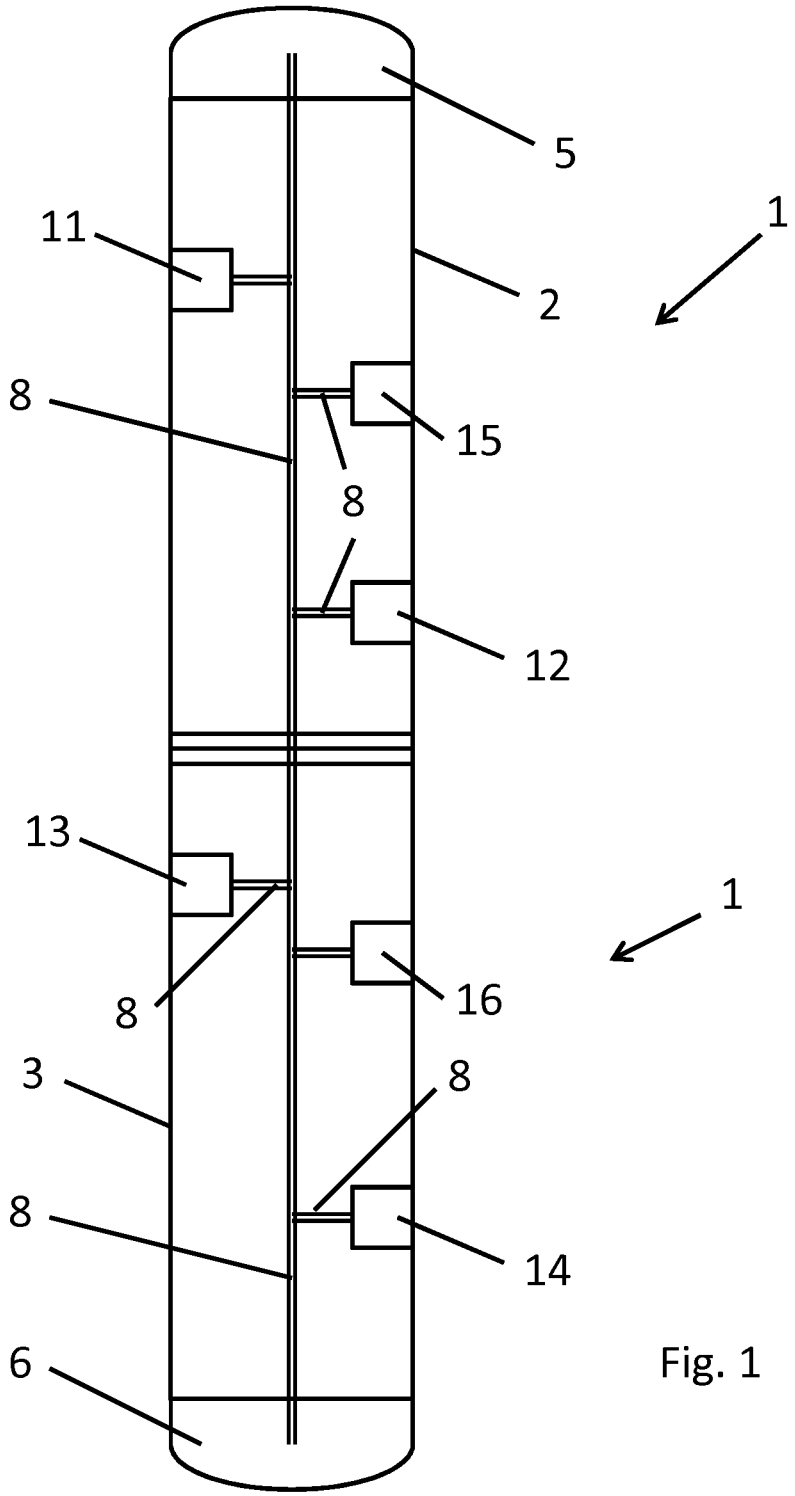
FIG. 1 is a schematic view of a train having two vehicles coupled together, wherein the figure shows a top view.

A railway train comprises a plurality of vehicles coupled together. In the example schematically shown in FIG. 1, two vehicles 2, 3 are coupled together (as indicated by three parallel horizontal lines) to form a train 1. Each of the vehicles 2, 3 is an end vehicle that has a driver's cab 5, 6. Communication lines 8 connect the two diver's cabs 5, 6 which means that the communication lines extend through the whole train 1.

In the example shown, each vehicle 2, 3 comprises two fire extinguisher cabinets 11, 12, 13, 14. Devices (not shown in FIG. 1) that are capable of controlling the cabinets 11, 12, 13, 14 to be unlocked are connected to the communication lines 8. These lines are part of the onboard control system of the vehicle 1. An example of a control system which can easily be modified to control unlocking fire extinguisher cabinets is the train control and management system (TCMS) offered by Bombardier Transportation under the brand name MITRAC.

Figure 2:
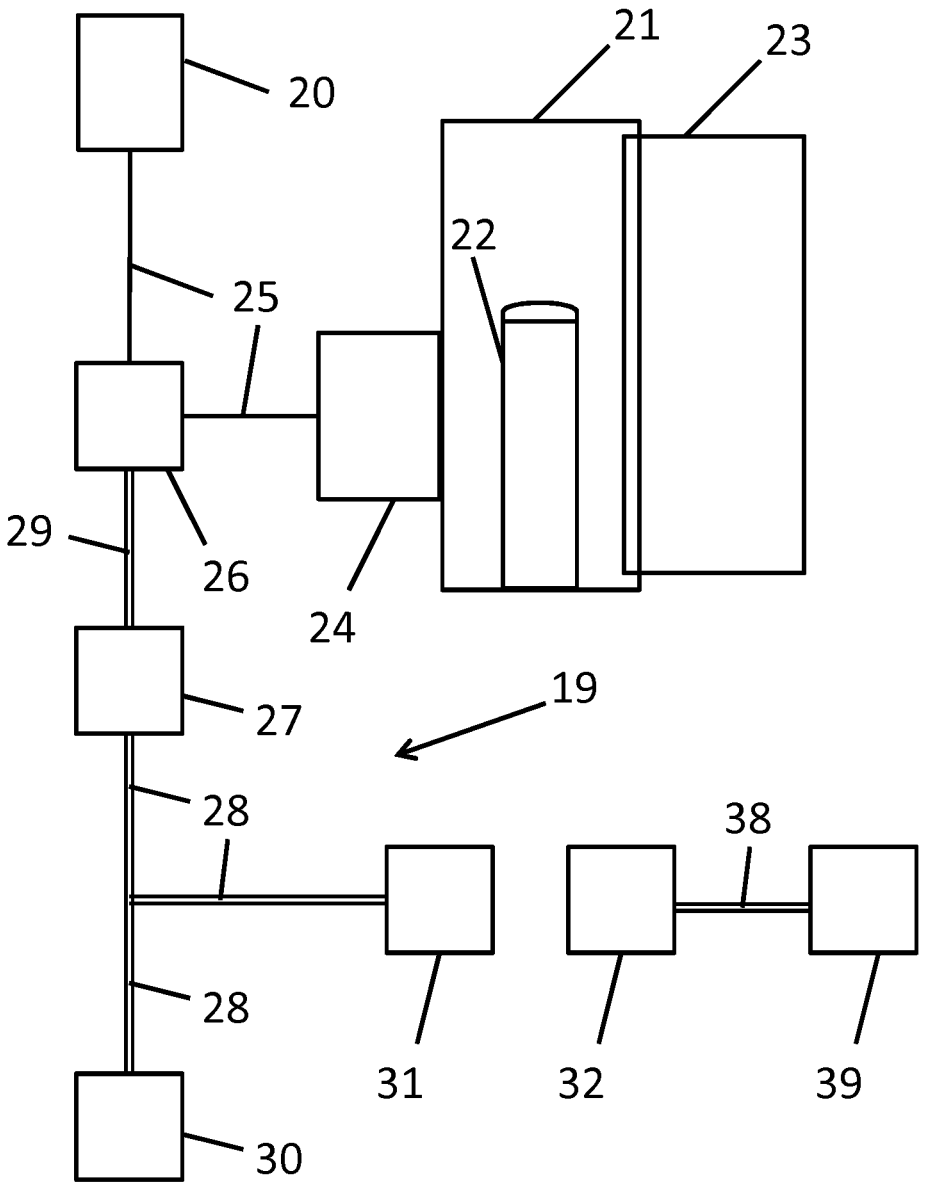
FIG. 2 is a schematic view of a block diagram with a fire extinguisher cabinet having a door and a lock that can remotely be unlocked.

FIG. 2 schematically shows a fire extinguisher 22 within a cabinet 21. A door 23, which is schematically shown in the open state, prevents removing the fire extinguisher 22 if it is in the closed state and if a lock 24 is in the locked state.

In the example shown, the lock 24 is an electric lock that is supplied with electric energy via an electric line 25 by an electric energy supply 20.

There is an actuating device 26 (for example a relay) combined with the electric line and the actuating device 26 can be controlled via a control line 29 by a control unit 27 to interrupt the electric line 25 and thereby the energy supply to the lock 24.

The control unit 27, communication lines 28 and connections to an onboard interacting device 30 and to an onboard radio interface are parts of an onboard control system 19. The communication lines 28 may form a data bus and/or other lines for communication between the devices that are connected to the communication lines 28. In particular, communication is performed by transferring signals, in particular control signals. It is also possible, that monitoring signals are transferred. Other devices which are controlled and/or monitored by the onboard control system 19 are not shown in FIG. 2.

FIG. 2 also shows a wayside radio interface 32 which can transmit communication signals wirelessly to the onboard radio interface 31 and also can receive signals wirelessly from the onboard radio interface. The wayside radio interface 32 is connected to a wayside interacting device 39 via a wayside communication line. The term "wayside" includes devices and lines which are not located next to the railway on which the vehicle which comprises the onboard device described above travels. For example, the wayside interacting device may be a control center for controlling traffic on a railway network. The wayside radio interface 32 may be placed next to the railway or at a distance to the railway which still allows for reliable wireless communication between rail vehicles on the railway and the wayside radio interface 32.

In the following, examples of operating the vehicle with respect to the use of the fire extinguisher 22 are described. During normal operation, when passengers are transported by the rail vehicle, for example by the train 1 shown in FIG. 1, the door 23 is closed so that there is no opening in the cabinet 21 that is large enough to remove the fire extinguisher 22. The closed state of the door 23 is secured by the lock 24 which is in the locked state during normal operation.

There are different cases in which the lock 24 should be in the unlocked state. One of these cases is the case of fire onboard the vehicle. Another case is maintenance and service. In particular, in case of fire, a fire detector (not shown in FIG. 2) may detect a fire. The fire detector may be connected—as shown for optional fire detectors 15, 16 in FIG. 1—to the communication lines 8 shown in FIG. 1 or to the communication lines 28 shown in FIG. 2.

If a fire detector detects a fire, it transmits a signal via the communication lines to the control system 19, for example to a computer of the control system that is performing monitoring functions including fire monitoring. The control system 19 then automatically transmits at least one signal to at least one of the following devices, an onboard display or other signaling device, or a plurality of displays and signaling devices, a monitoring device of the control system, such as the computer mentioned before, and a wayside device or a plurality of wayside devices, such as a device in a control center. In case of displays and signaling devices, the fire detection signal causes a picture or signal that can be recognized by a user, such as a member of staff, in particular the driver of the vehicle. In case of a monitoring device, the fire detection signal causes an automatic process in reaction to the detected fire. The preferred process is the automatic unlocking of the lock 24. In addition or alternatively, unlocking the lock 24 may be demanded by a user, in particular the user which has recognized the corresponding picture or signal. This user is not necessarily a user within the rail vehicle. Alternatively, a person in the control center or another member of staff on the wayside or in other rail vehicles may demand the lock 24 to be unlocked.

If the control system 19 receives a signal including the demand to unlock the lock 24, for example from the onboard interacting device 30 (via the communication lines 28) or from the wayside interacting device 39 (via the wayside communication line 38, the wayside radio interface 32, the onboard radio interface 31 and the onboard communication lines 28), the control unit 27 of the control system 19 controls the actuating device 26 to open the electric line 25. Therefore, the lock 24, which is now disconnected from its energy supply, automatically unlocks so that the door 23 can be opened or is opened automatically.

Other embodiments of an electric lock have been described before and different processes of unlocking the lock 24 can also be realized with the arrangement schematically shown in FIG. 2.

In case of required maintenance or service, the demand to unlock the lock 24 can be entered by a user in the same manner as mentioned above. Alternatively, as preferred, a user can directly act on the cabinet, for example by using a key. Alternatively, the lock may be combined with a keypad and may type in a secret code so that the lock is brought automatically into the unlocked state.

The invention claimed is:

1. An arrangement, the arrangement comprising:

a control system of a rail vehicle, the control system being adapted to control a plurality of different devices;

a cabinet having a lock configured for locking in order to prevent access to a valuable device within the cabinet;

a control unit of the control system adapted to remotely control unlocking the lock, an electric line adapted to supply the lock with electric energy from an electric energy supply network of the rail vehicle; and a fire detector connected to the control system to transmit a signal indicative of a fire on the rail vehicle to the control system;

wherein the control system is adapted to:

unlock the lock automatically if a signal indicative of a fire is received from the fire detector, and unlock the lock automatically by disconnecting the electric line adapted to supply the lock with electric energy; and wherein the lock is operated using the electric energy supply network of the rail vehicle, and wherein the lock is adapted to unlock if the electric energy supply network stops applying an electric voltage to the lock via the electric line.

2. The arrangement of claim 1, wherein the control system is adapted to unlock the lock on demand of a user inside or outside of the rail vehicle.

3. The arrangement of claim 1, wherein the control system is adapted to display a signal that can be recognized by a user if the fire detector connected to the control system detects a fire within the rail vehicle.

4. The arrangement of claim 1, wherein the lock comprises an unlocking device that can be actuated by a user by directly acting on the unlocking device, and wherein the unlocking device can only be actuated to unlock the lock using at least one of secret knowledge and a key.

5. The arrangement of claim 1, further comprising:

a plurality of cabinets, each cabinet of the plurality of cabinets having a lock configured for locking in order to prevent access to a valuable device within the cabinet, wherein the control system is adapted to use a single control line to control the plurality of cabinets as a group, and wherein the control unit of the control system is adapted to remotely control unlocking of the lock of each cabinet so that the lock of each cabinet opens if the electric energy supply network stops applying the electric voltage to the lock of each cabinet via the electric line.

6. The arrangement of claim 1, wherein the control system comprises an interface for communication from a location outside of the rail vehicle.

7. The arrangement of claim 1, wherein the control system is adapted to trigger display of video data from a camera monitoring an area where the cabinet is placed within the rail vehicle.

8. The arrangement of claim 7, wherein the control system is adapted to display the video data in a location to be viewed by an operator of the rail vehicle.

9. A method, the method comprising:

using a control system onboard a rail vehicle to control a plurality of different devices onboard the rail vehicle, wherein the control system is used to remotely unlock automatically a lock of a cabinet in order to prevent access to a valuable device within the cabinet that is otherwise locked; and wherein the control system is adapted to:

unlock the lock automatically if a signal indicative of a fire on the rail vehicle is received from a fire detector of the rail vehicle that is connected to the control system, and unlock the lock automatically by disconnecting an electric line adapted to supply the lock with electric energy; and wherein the lock is operated using an electric energy supply network of the rail vehicle, and wherein the lock unlocks if the electric energy supply network stops applying an electric voltage to the lock.

10. The method of claim 9, wherein the control system is adapted to unlock the lock on demand of a user inside or outside of the rail vehicle.

11. The method of claim 9, further comprising:

unlocking the lock using the control system automatically if the fire detector connected to the control system detects a fire within the rail vehicle.

12. The method of claim 9, wherein the lock comprises an unlocking device configured to be actuated by a user by directly acting on the unlocking device, and wherein the unlocking device can only be actuated to unlock the lock using at least one of secret knowledge or a key.

* * * * *